United States Patent [19]

Kumagai

[11] Patent Number: 4,666,321

[45] Date of Patent: May 19, 1987

[54] ELECTRONIC TYPEWRITER SELECTIVELY RESPONSIVE TO SET TABS AND SET DECIMAL POINT TABS

[75] Inventor: Kaoru Kumagai, Tokyo, Japan

[73] Assignee: Canon Kabushiki Kaisha, Tokyo, Japan

[21] Appl. No.: 702,887

[22] Filed: Feb. 19, 1985

[30] Foreign Application Priority Data

Feb. 29, 1984 [JP] Japan ..... 59-35947

[51] Int. Cl.[4] ..... B41J 21/14

[52] U.S. Cl. ..... 400/285; 400/285.1; 400/285.4

[58] Field of Search ..... 400/63, 76, 279, 285, 400/285.1, 285.20, 285.3, 285.4, 285.5, 285.6

[56] References Cited

U.S. PATENT DOCUMENTS

| | | | |
|---|---|---|---|
| 2,478,630 | 8/1949 | Hill | 400/285 X |
| 4,212,553 | 7/1980 | Acosta et al. | 400/279 |
| 4,500,216 | 2/1985 | Demonte et al. | 400/63 X |

OTHER PUBLICATIONS

IBM Technical Disclosure Bulletin, "Text Formatting", Kolpek, vol. 16, No. 2, Jul. 1973, pp. 391–394.

IBM Technical Disclosure Bulletin, "Method for Executing a Decimal Tab Operation on a Proportional Spacing Printer Using Text Recorded on a Fixed Escapement Printer", Garcia et al, vol. 22, No. 5, Oct. 1979, p. 1753.

IBM Technical Disclosure Bulletin, "Format Control Functions", Adam et al, vol. 25, No. 1, Jun. 1982, pp. 217–220.

*Primary Examiner*—Ernest T. Wright, Jr.

*Attorney, Agent, or Firm*—Fitzpatrick, Cella, Harper & Scinto

[57] ABSTRACT

An electronic typewriter includes: a carriage mounting a printing unit; a control unit for controlling the movement of the carriage; a first setting unit for setting a print start position at a preset position, a second setting unit for setting a decimal point tab position so as to align decimal point positions while printing; and a decision unit for deciding whether the control unit is to control the carriage on the basis of the decimal point position set by the second setting unit. The carriage is stopped at the decimal tab position if it is necessary, while the carriage is not stopped at the decimal tab position if it is not necessary. Thus, the operator can perform the tab operations without paying attention to the decimal tab position. Alternatively, instead of the decimal tab position, such control may apply to the tab position.

19 Claims, 8 Drawing Figures

FIG. 2 (B1)
PRIOR ART

ELECTRONIC TYPEWRITER SELECTIVELY RESPONSIVE TO SET TABS AND SET DECIMAL POINT TABS

BACKGROUND OF THE INVENTION

1. Field of the Invention

The present invention relates to an electronic typewriter, and more particularly it relates to an electronic typewriter in which operations for tabulation and decimal tabulation or the like can be easily carried out.

2. Description of the Prior Art

Electronic typewriters having a tabulation function (for moving a carriage to a definite position with a single key manipulation) to simplify table formation, or the like are known in the art. Among those, a large number are of the type that in addition to such ordinary tabulation function, an additional decimal tabulation function is provided. Thus, a decimal tabulation operation may also be carried out as well as a tabulation operation. In order to perform tabulation or decimal tabulation operations, the operator depresses a tab or tabulation key described later to drive and move a carriage to the next tab position or decimal position. If the stopped position is a decimal tab position, a decimal tab key input is required for further operations. As the tab key is again depressed during the decimal tabulation input, decimal tabulation printing is executed and the carriage is moved to the subsequent tab position or decimal tab position. In this case, if the stopped position of the carriage is a decimal tab position, a decimal tab key input is further required as above.

In the tabulation and decimal tabulation operations, the carriage moves in accordance with the manipulations of the tab key which the operator depresses. In the case that the stopped position of the carriage is a decimal tab position, a decimal tabulation operation is effected automatically.

With conventional electronic typewriters of this type, however, the carriage stops always at a decimal tab position even when the operator wishes to perform only a tabulation operation. Therefore, in order to move the carriage to the next tab position, the operator has heretofore been required to depress the tab key one or more additional times. Such operation will be described in connection with FIGS. 1(A) and 1(B) showing a relation between carriage positions and printed outputs. In FIG. 1(A), reference labels LM and RM designate left and right margins, respectively, reference labels T1 to T3 designate tab positions, and reference labels DT1 to DT2 designate decimal tab positions. The operations required of the operator intending to print out a series of characters "JAPAN 123.456 321.654" shown in FIG. 1(A), are as shown in FIG. 2(A). In particular, as shown in FIG. 2(A), first the tab key is depressed (step S11); a word "JAPAN" is key-input (step S12); the tab key is depressed (step S13); the number "123.456" is key-input (step S14); the tab key is depressed (step S15); the tab key is again depressed (step S16); a numeral "321.654" is key-input (step S17); and last the tab key is depressed (step S18).

Next, the operations required of the operator intending to print out a series of characters "TOTALA TOTALB" shown in FIG. 1(B), are as shown in FIG. 2(B1). In particular, as shown in FIG. 2(B1), first the tab key is depressed (step S21); a word "TOTALA" is key-input (step S22); the tab key is depressed (step S23); the tab key is again depressed (step S24); a word "TOTALB" is key-input (stepS25); and last the tab key is depressed (step S26).

Therefore, in printing out a series of characters shown in FIG. 1(B), the tab key must be depressed (as in step S23) even in the case that the decimal tabulation operation is not required. Consequently, the operator must carry out his manipulations bearing in mind a line format of both tab and decimal tab positions.

SUMMARY OF THE INVENTION

The present invention has been made in view of the above prior art problems, and it is an object of the present invention to provide an electronic typewriter which can select either one of the functions to perform only a tabulation operation or to perform both tabulation and decimal tabulation operations.

It is aother object of the present invention to provide an electronic typewriter in which the movement of a carriage to a desired position in the selected operation can be controlled so as to be achieved with a single key manipulation.

BRIEF DESCRIPTION OF THE DRAWINGS

FIGS. 2(A) and 2(B1) are flow charts showing the manipulations with a conventional electronic typewriter;

FIG. 2(B2) is a flow chart showing an example of the manipulations with the electronic typewriter according to the present invention;

DETAILED DESCRIPTION OF THE PREFERRED EMBODIMENTS

The present invention will now be described in detail with reference to the accompanying drawings.

Figure 3:
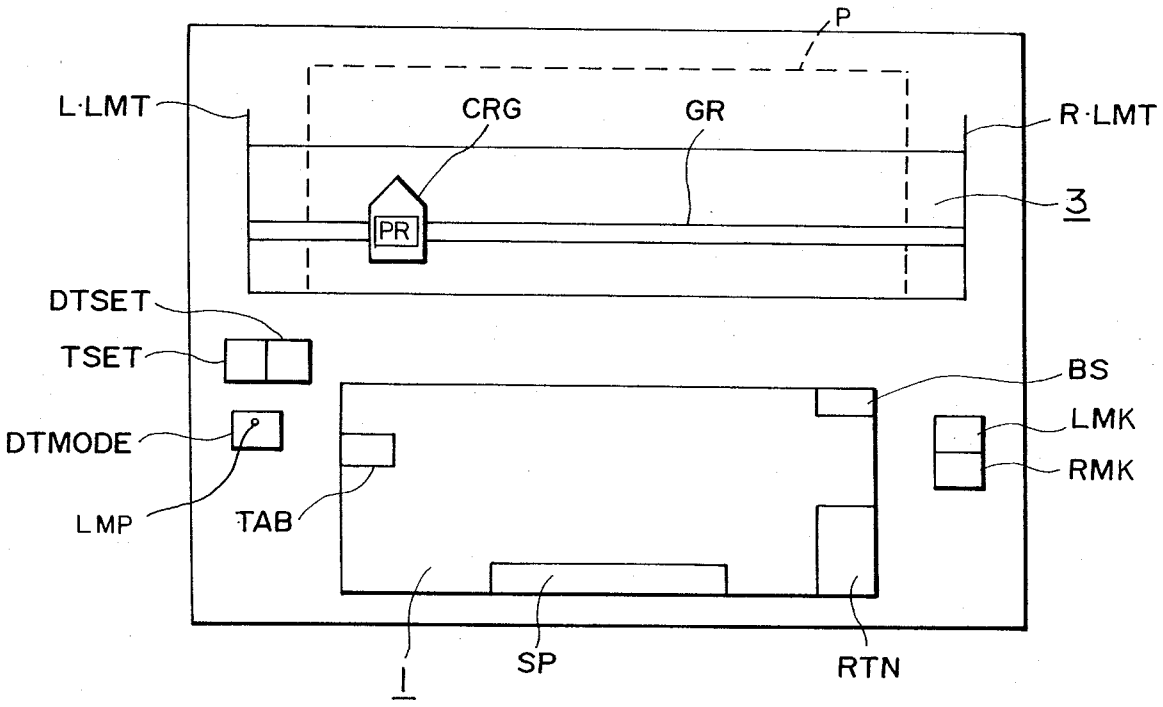
FIG. 3 is a diagrammatic plan view of the electronic typewriter according to the present invention.

FIG. 3 shows diagrammatically an example of a structural arrangement of the electronic typewriter according to the present invention. Reference number 1 denotes a keyboard unit which is provided with character/symbol input keys and various function keys described later. Reference number 3 denotes a printer such as a serial printer. CRG represents a carriage mounting a printing unit PR (printing head), the carriage CRG being moved in the main scanning direction relative to a printing paper P. The carriage CRG may also be moved, upon depression of either a space key SP or a back space key BS, along a guide rail GR over the range between a left limiter L.LMT and a right limiter R.LMT.

LMK represents a left margin position setting key and RMK represents a right margin position setting key. By depressing both keys KMK and RMK, it is possible to set the range of movement of the carriage CRG.TSET represents a tab. position setting key and DTSET represents a decimal tab setting key. The former can set tab positions and the latter can set decimal tab positions, respectively within the range between the left limiter L.LMT and right limiter R.LMT.TAB represents a tab key which is used for causing the carriage CRG to move to the next tab or decimal tab position preset respectively with the tab or decimal tab setting key TSET or DTSET, respectively, and which is used for causing the execution of a decimal tabulation operation. RTN represents a return key for performing a line feed/return for the carriage CRG. Upon depression of the key RTN, the carriage CRG is returned to the left margin position and the paper P is line-fed relative thereto. DTMODE represents a decimal tab effective mode key with a display lamp such as a light emitting LMP. The key DTMODE is used for the movement of the carriage CRG to the decimal tab position and for the execution of a decimal tabulation operation.

Figure 4:
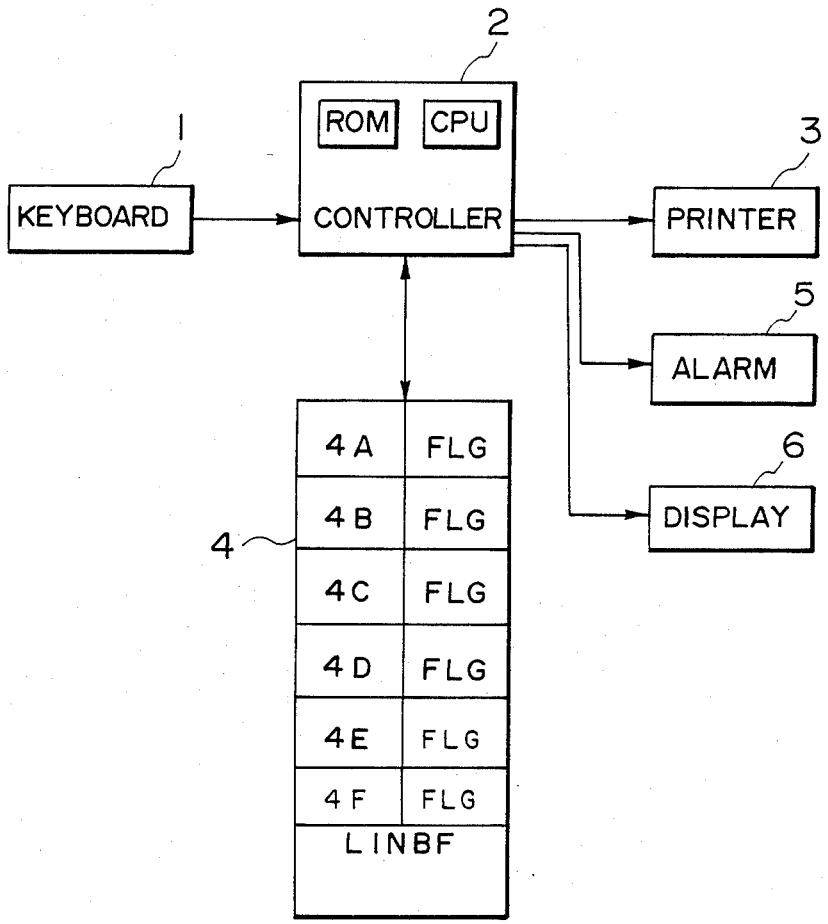
FIG. 4 is a system diagram of the electronic typewriter according to the present invention.
Figure 5:
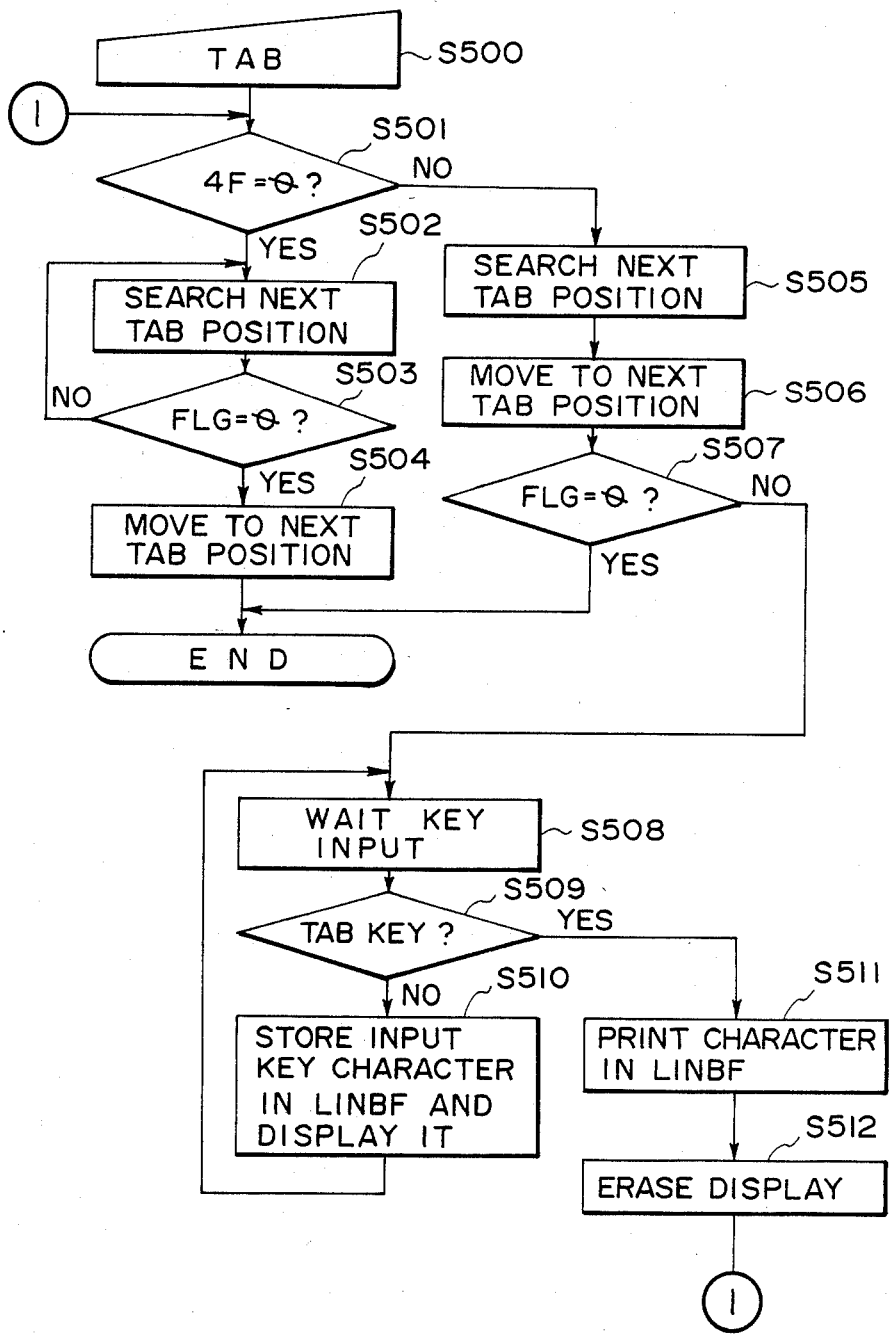
FIG. 5 is a flow chart showing an example of the manipulation sequence of the electronic typewriter according to the present invention.

FIG. 4 shows an embodiment of a system arrangement of the electronic typewriter according to the present invention. In the figure, reference number 1 denotes the keyboard unit, and reference number 2 denotes a control unit having a CPU and a ROM wherein programs as shown in a control chart of FIG. 5 are stored. The control unit 2 controls a memory device 4 storing such information as line formatting for the keyboard 1, an alarm 5 for, for example, signalling approach of the carriage to the right margin RM, a display device 6 such as an LCD, a printer 3, and tab setting positions and the like.

Input information from the keyboard unit 1 is processed at the control unit 2 in accordance with the kind of signals input thereto. The processed results are delivered to the display device 6, printer 3, and memory device 4. At this time, the control unit 2 reads out the line formatting information stored in the memory device 4, the line formatting being described later in detail.

The memory device 4 has pointers as indicated by 4A to 4E. The pointers 4A to 4E are for indicating tab and decimal tab positions existing between the left and right limiters L.LMT and R.LMT. Flags FLG corresponding to these pointers 4A to 4D indicate the respective performances of the pointers; i.e., in those flags, 0 stands for a tabulation operation and 1 stands for a decimal tabulation operation. Pointer 4E indicates the depressed conditions of the decimal tab effective mode key DTMODE; i.e., 0 stands for an ineffective or undepressed state of the decimal tab position and 1 stands for an effective or depressed state of the decimal tab position. Pointer 4F indicates whether the decimal tab effective mode key DTMODE has been depressed or not; i.e., 0 stands for the undepressed state and in this state the LED lamp LMP of the key DTMODE extinguishes and 1 stands for the depressed state and in this state the LED lamp LMP of the key DTMODE illuminates. Furthermore, the memory device 4 has a buffer called a line buffer LINBF for use in displaying an input character or in printing out an input character. With this line buffer LINBF, it is possible to display on the display device 6 a character input by the operator waiting for the key input during a decimal tabulation operation.

Next, the control operations of the electronic typewriter according to the present invention will be described with reference to FIG. 5. The programs described herein have been stored in the ROM of the control unit 2 shown in FIG. 4. S500 to S512 each represent a step in the control sequence.

First, the control unit 2 waits for any one of the key inputs. In this condition, it is here assumed that the tab key TAB is depressed (S500). At step S501, referring to the flag FLG of the pointer 4F in the memory device 4, it is checked whether the decimal tab effective mode key DTMODE is presently effective or ineffective. In the case the pointer 4F indicates 0, step S502 follows, wherein the information about the nearest position to the right side of the carriage CRG is fetched from among those indicated by the pointers 4A to 4D in the memory device 4. Next, at step S503, the contents of the flag FLG corresponding to the fetched pointer are judged to determine whether they are 0 or 1. This judgement is to determine whether the fetched pointer is an ordinary tab pointer or not, that is, whether FLG=0 or not. If the flag FLG is 1, then step S502 is performed again to search the next nearest tab position. If the flag FLG=0 at step S503, then step S504 follows in accordance with which the carriage CRG is moved to the fetched tab position and the tabulation operation terminates.

In the case that the pointer 4F is not 0 at step S501, that is, in the case that the LED lamp LMP of the decimal tab effective mode key DTMODE illuminates, step S505 follows. At step S505, the information about the nearest position to the right side of the carriage CRG is fetched from among those indicated by the pointers 4A to 4D in the memory device 4. Succeedingly, at step S506, the carriage CRG is moved to the tab position identified at step S505. Upon completion of the movement, at step S507 the contents of the flag FLG corresponding to the pointer are judged to determine whether they are 0 or 1. In the case of FLG=0, since this case corresponds to the ordinary tabulation operation, the tabulation operation terminates. In the case of FLG=1, step S508 follows, at which a key input is waited in order to perform a decimal tabulation function. Next, following a key input, at step S509 it is judged whether the depressed key is the tab key TAB or not. If the depressed key is an ordinary key, at step S510 the input key information is stored in the line buffer LINBF and in addition the input character is displayed on the display device 6. Thereafter, step S509 is performed again to wait for a further key input. While on the other hand, if the depressed key is the tab key TAB in step S509, step S511 follows, at which the contents of the line buffer LINBF are printed out using the printer 3. Next, at step S512, the characters and the like displayed on the display device 6 are erased, and step S501 is restored in order to move the carriage to the next tab position.

Figure 1A:
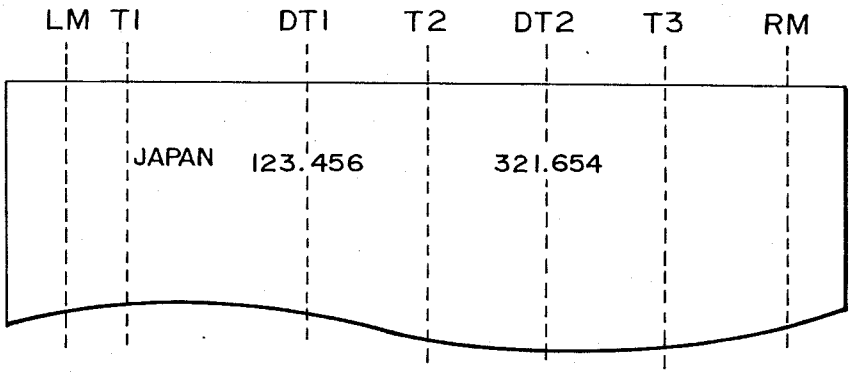
FIGS. 1(A) and 1(B) are views for illustrating an example of printed characters with an electronic typewriter.
Figure 1B:
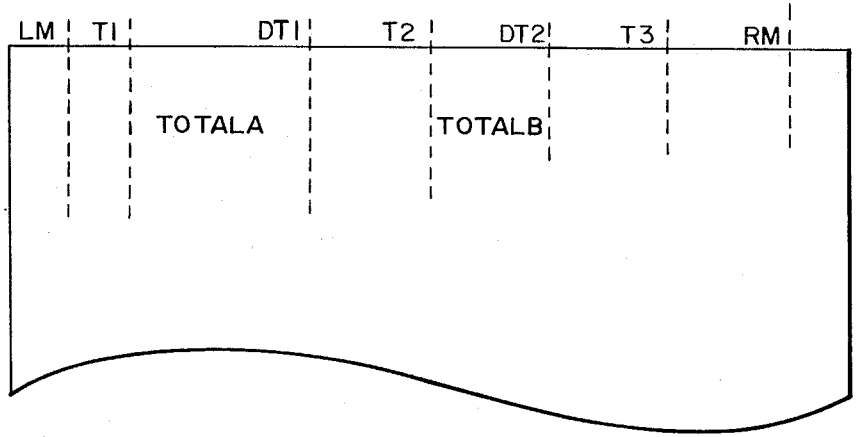
Figure 2:
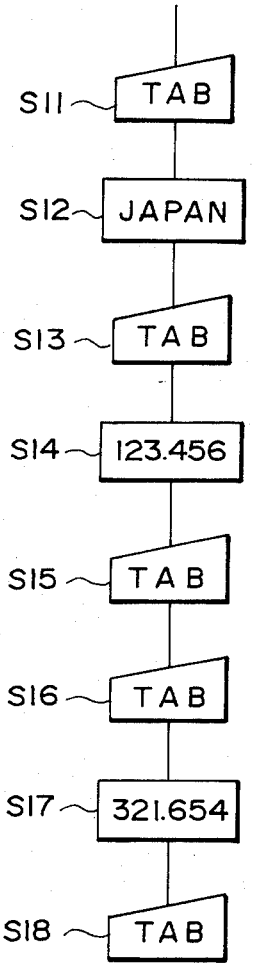
FIG. 2 (A) PRIOR ART
Figure 2:
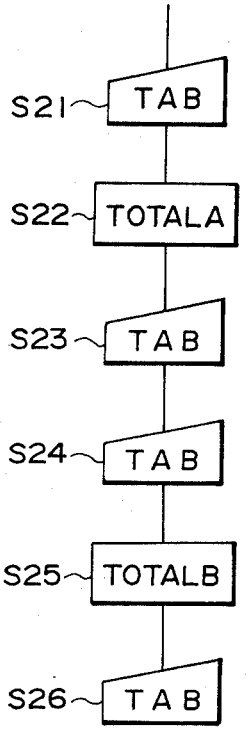
FIG. 2 (A) PRIOR ART
Figure 2:
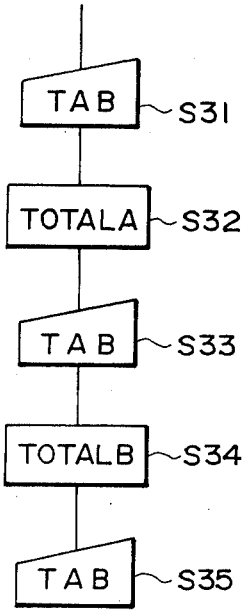
FIG. 2 (A) PRIOR ART

As seen from the above description, if for example a series of characters shown in FIG. 1(B) are assumed to be printed out, the operations by the operator after turning on the decimal tab effective mode key DTMODE, are as shown in FIG. 2(B2). In particular, first the tab key is depressed (step S31); a word "TOTALA" is key-input (step S32); and the tab key is depressed (step S33). A single depression of the tab key TAB at this step makes the carriage CRG pass through the position DT1 and move to the position T2; a word TOTALB is key-input (step S34), and last the tab key TAB is depressed (step S35). As seen from the above, the operator is not required to consider decimal tab position or positions.

As described above, according to the present invention, the presence or absence of a decimal tab position on a one line format is checked. The carriage is stopped at the decimal tab position if it is necessary, while the carriage is not stopped at the decimal position if it is not necessary. Thus, the operator can perform the tab operations without paying attention to the decimal tab position. Further, it is possible to provide an electronic typewriter which can select any one of the functions either to perform only a tabulation operation or to perform both tabulation and decimal tabulation operations. Furthermore, it is possible to provide an electronic typewriter in which the movement of the carriage to a desired position in a selected operation can be performed with a single operation. Although the selection judgment in the above description has applied to whether the decimal tab position is effective or not, it is apparent that alternative judgment selection applying to whether the tab position is effective or not may also be used.

What I claim is:

1. An electronic typewriter comprising:
a movable carriage;
a printing unit mounted on said carriage;
control means for controlling the movement of said carriage;
first setting means for setting at least one print start position of said carriage at a predetermined position;
second setting means for setting at least one decimal point position of said carriage when decimal point positions are to be aligned during printing by said printing unit; and
decision means for deciding whether or not said control means is to cause said carriage to stop at positions corresponding to the at least one decimal point position set by said second setting means in response to information from said second setting means.

2. An electronic typewriter according to claim 1, wherein said first setting means is a tab position setting key.

3. An electronic typewriter according to claim 1, wherein said second setting means is a decimal tab position setting key.

4. An electronic typewriter according to claim 3, wherein said decision means is a decimal tab effective mode key for making said decimal tab position setting key effective.

5. An electronic typewriter comprising:
a movable carriage;
a printing unit mounted on said carriage;
setting means capable of setting a print start position of said carriage at a plurality of desired positions;
decision means for deciding whether or not at least a predetermined one of the desired positions set by said setting means is to be ignored during printing by said print unit; and
control means for controlling said carriage to sequentially move to said plurality of desired positions and for ignoring the at least one predetermined position in response to the decision by said decision means.

6. An electronic typewriter according to claim 5, wherein said carriage is mounted for movement in a predetermined direction and to stop at the desired positions.

7. An electronic typewriter according to claim 5, wherein said setting means comprises at least one of a tab setting means and a decimal tab setting means.

8. An electronic typewriter according to claim 7, wherein said control means selectively ignores at least one of a tab position and a decimal tab position set by said setting means.

9. An electronic typewriter comprising:
a movable carriage;
a printing head mounted on the carriage;
storing means for separately storing a plurality of tab stop information and decimal tab stop information for one line;
access means for selectively accessing said decimal tab stop information stored in said storing means; and
setting means for setting said carriage to a decimal tab stop position which is the closest to the current position of said carriage in response to access thereof by said access means.

10. An electronic typewriter according to claim 9, further comprising a key indicating availability of said decimal tab stop information, said access means being responsive to said key.

11. An electronic typewriter according to claim 9, further comprising a tab key, said access means being responsive to said tab key.

12. An electronic typewriter according to claim 9, further comprising a second access means for selectively accessing the tab stop information stored in said storage means.

13. An electronic typewriter comprising:
a movable carriage;
a printer head mounted on said carriage;
storing means for separately storing a plurality of tab stop information and decimal tab stop information for one line;
decision means for deciding (1) whether both the tab stop information and decimal tab stop information are to be accessed or (2) whether only the tab stop information is to be accessed from said storing means; and
control means for controlling movement of said carriage in response to the decision of said decision means.

14. An electronic typewriter according claim 13, further comprising a key indicating availability of decimal tab stop information, and wherein said deciding means responds to said key.

15. An electronic typewriter according to claim 13, wherein said control means stops movement of said carriage in response to one of the tab stop information and the decimal tab stop information.

16. An electronic typewriter comprising:
a movable carriage;
a printer head mounted on said carriage;
control means for controlling the movement of said carriage;
storing means for separately storing a plurality of tab stop information and decimal tab stop information;
access means for selectively assessing the decimal tab stop information stored in said storing means; and
output means for outputting input information;
said control means enabling said carriage to move to a decimal tab stop position in response to said decimal tab stop information accessed by said access means.

17. An electronic typewriter according to claim 16, further comprising a tab key and other keys, and wherein after said carriage is moved to the decimal tab stop position, said output means prints upon the depression of said tab key and said output means displays upon the depression of said other keys.

18. An electronic typewriter comprising:
character input means for inputting characters at input positions;

storing means for separately storing a plurality of tab stop position information and decimal tab stop position information;

access means for selectively accessing said decimal tab stop position information stored in said storing means; and means for setting the character input position of said input means at a decimal tab stop position which is the closest to the current character input position in response to access of decimal tab stop position information by said access means.

19. An electronic typewriter according to claim 18, further comprising display means for displaying characters input by said input means.

* * * * *

UNITED STATES PATENT AND TRADEMARK OFFICE

CERTIFICATE OF CORRECTION

PATENT NO. : 4,666,321

DATED : May 19, 1987

INVENTOR(S) : KAORU KUMAGAI

It is certified that error appears in the above-identified patent and that said Letters Patent is hereby corrected as shown below:

COLUMN 1

Line 16, "those," should read --those electronic typewriters,--.

COLUMN 2

Line 1, "(stepS25);" should read --(step S25);--.
Line 17, "aother" should read --another--.
Line 63, "KMK" should read --LMK--.
Line 65, "CRG.TSET" should read --CRG. TSET--.

COLUMN 3

Line 1, "R.LMT.TAB" should read --R.LMT. TAB--.
Line 12, "light emitting" should read --light-emitting--.
Line 13, "LMP." should read --diode LMP.--.

COLUMN 4

Line 10, "judgement" should read --judgment--.
Line 58, "TOTALB" should read --"TOTALB"--.
Line 64, "one line" should read --one-line--.

COLUMN 5

Line 51, "print" should read --printing--.

UNITED STATES PATENT AND TRADEMARK OFFICE

CERTIFICATE OF CORRECTION

PATENT NO. : 4,666,321

DATED : May 19, 1987

INVENTOR(S) : KAORU KUMAGAI

It is certified that error appears in the above-identified patent and that said Letters Patent is hereby corrected as shown below:

COLUMN 6

Line 23, "storage" should read --storing--.
Line 36, "of" should read --by--.
Line 38, "according claim" should read --according to claim--.
Line 53, "assessing" should read --accessing--.

Signed and Sealed this

Thirteenth Day of October, 1987

*Attest:*

DONALD J. QUIGG

*Attesting Officer*

*Commissioner of Patents and Trademarks*